US007640712B1

(12) United States Patent
Eshelman

(10) Patent No.: US 7,640,712 B1
(45) Date of Patent: Jan. 5, 2010

(54) WINDOW GLAZING ASSEMBLY HAVING A CARBON FIBER INSERT MEMBER

(75) Inventor: H. Jay Eshelman, Putney, VT (US)

(73) Assignee: The Woodstone Company, Westminster, VT (US)

( * ) Notice: Subject to any disclaimer, the term of this patent is extended or adjusted under 35 U.S.C. 154(b) by 0 days.

(21) Appl. No.: 11/896,288

(22) Filed: Aug. 30, 2007

Related U.S. Application Data

(60) Provisional application No. 60/840,960, filed on Aug. 30, 2006.

(51) Int. Cl.
*E04C 3/00* (2006.01)
*E06B 3/663* (2006.01)

(52) U.S. Cl. ..... 52/846; 52/847; 52/456

(58) Field of Classification Search ..... 52/314, 52/312, 311.3, 456, 455, 847, 846, 836
See application file for complete search history.

(56) References Cited

U.S. PATENT DOCUMENTS 190,225 A 5/1877 Landeker
961,728 A 6/1910 McCginnis
1,000,413 A 8/1911 Kane
1,093,587 A * 4/1914 McClure ..... 52/456
1,108,914 A * 9/1914 Landolt ..... 52/456
1,132,233 A * 3/1915 Wataon et al. ..... 52/456
1,171,444 A * 2/1916 Larson et al. ..... 52/800.16
1,187,491 A * 6/1916 Bogenberger ..... 52/846
1,211,079 A * 1/1917 Callahan ..... 52/455
1,211,959 A * 1/1917 Pinckney ..... 52/455
1,242,904 A 10/1917 Ashby
1,243,020 A * 10/1917 Waugh ..... 52/204.591
1,347,706 A 7/1920 Motteau
1,430,996 A * 10/1922 Horlin ..... 52/745.05
1,639,148 A * 8/1927 Redrup ..... 52/455
1,740,622 A * 12/1929 Owens et al. ..... 52/204.591
1,921,074 A * 8/1933 Exner ..... 52/764
2,010,520 A * 8/1935 Kiekert ..... 49/460
2,032,693 A 3/1936 Fries et al.
2,193,299 A * 3/1940 Schottenberg ..... 403/270
2,322,700 A * 6/1943 Mussey ..... 52/455
2,699,233 A 1/1955 Cameron
2,760,609 A 8/1956 Hagerty
2,800,983 A * 7/1957 Toney ..... 52/464
2,866,527 A 12/1958 Schilling
3,028,938 A 4/1962 Schorr
3,678,651 A * 7/1972 Hicks ..... 52/204.61
3,766,698 A 10/1973 Dallen
3,810,338 A 5/1974 Wolfert
4,222,210 A * 9/1980 Hanstein et al. ..... 52/461
4,241,556 A * 12/1980 Bursk ..... 52/455
4,439,969 A 4/1984 Bartlett
4,610,901 A * 9/1986 Linscott ..... 428/38
4,730,429 A * 3/1988 Roberts ..... 52/309.13

(Continued)

*Primary Examiner*—Gay Ann Spahn
(74) *Attorney, Agent, or Firm*—Shlesinger, Arkwright & Garvey LLP

(57) ABSTRACT

The invention is a window glazing assembly having a series of segmented and non-segmented intersecting muntins for supporting glass panes. The non-segmented muntins incorporate a continuous carbon fiber insert that is disposed interior of the non-segmented muntin which rests directly against a perimeter edge of the glass panes. The glazing assembly safely disperses wind load or other forces acting against the glass panes.

14 Claims, 4 Drawing Sheets

U.S. PATENT DOCUMENTS 4,745,723 A * 5/1988 Esposito ..... 52/464
4,750,310 A * 6/1988 Holcombe ..... 52/844
4,845,911 A * 7/1989 Winston et al. ..... 52/456
4,860,517 A * 8/1989 Kipross ..... 52/656.2
4,961,975 A * 10/1990 Bejnar ..... 428/34
5,040,347 A * 8/1991 Valvis ..... 52/204.591
5,088,255 A 2/1992 Emanuel
5,107,643 A * 4/1992 Swensen ..... 52/202
5,222,339 A * 6/1993 Hendrickson et al. ..... 52/456
5,226,919 A * 7/1993 Milligan ..... 52/314
5,251,417 A 10/1993 Yates, Jr.
5,331,727 A * 7/1994 Golen ..... 29/453
5,333,428 A * 8/1994 Taylor et al. ..... 52/308
5,351,459 A 10/1994 Kassl et al.
5,501,888 A 3/1996 Hanson et al.
5,533,314 A * 7/1996 Kunert ..... 52/788.1
5,579,794 A * 12/1996 Sporta ..... 135/88.01
5,617,684 A * 4/1997 Sheath ..... 52/204.57
5,727,356 A * 3/1998 Ensinger et al. ..... 52/717.02
5,744,225 A * 4/1998 Kujirai et al. ..... 52/306
5,791,102 A * 8/1998 Sheath et al. ..... 52/204.7
5,924,263 A * 7/1999 Richardson ..... 52/204.57
6,301,852 B1 * 10/2001 Eshelman ..... 52/456
6,360,498 B1 * 3/2002 Westphal ..... 52/204.5
6,425,221 B1 * 7/2002 Reichert ..... 52/456
6,470,639 B1 10/2002 Horn et al.
6,546,682 B1 * 4/2003 DeBlock et al. ..... 52/204.72
6,550,204 B1 4/2003 Herrera et al.
6,955,012 B2 * 10/2005 Suzuki ..... 52/198
7,043,885 B2 5/2006 LeMert
7,080,490 B2 7/2006 Horn et al.
2003/0000163 A1 * 1/2003 Lamanna ..... 52/204.62
2006/0196146 A1 * 9/2006 Schwegler ..... 52/741.15
2008/0155913 A1 * 7/2008 Magill ..... 52/204.61

* cited by examiner

WINDOW GLAZING ASSEMBLY HAVING A CARBON FIBER INSERT MEMBER

CROSS-REFERENCE TO RELATED APPLICATIONS

This application claims the benefit of U.S. Provisional Application Ser. No. 60/840,960 filed on Aug. 30, 2006.

BACKGROUND OF THE INVENTION

Historic landmark criteria require the wooden sash and doors of designated buildings be fabricated using traditional techniques and construction materials. These traditional construction methods, although aesthetically pleasing and architecturally correct, do not provide adequate wind load and impact resistance. Because building codes in many states now require door and window assembly to meet specific hurricane resistance requirements, a need has existed in the art for a glazing system that meets historic landmarks requirements in terms of construction methods and traditional materials yet at the same time provide hurricane level wind load and impact resistance. The present invention is an effort to meet those needs.

The present invention relates to window and door structures and in particular, an improved muntin assembly for securing and sealing glass panes within a window or door frame.

BRIEF SUMMARY OF THE INVENTION

The present invention is directed to window glazing assembly for supporting and separating a series of individual panes of glass within the sash or a window or door, the assembly comprises a series of continuous exterior muntin bars adapted to extend from one end of the sash to an opposite end and a series of cooperating interior muntin cap operatively associated with the exterior muntin bar to support a plurality of windowpanes. One edge of the exterior muntin bar is received within the interior muntin cap to form a connection. A carbon fiber insert having a channel portion is disposed between the exterior muntin bar and the interior of the muntin cap. The carbon fiber insert includes at least one flange member adapted to contact the peripheral edge of a windowpane to be supported so that any wind load or impact against the windowpane is caused to be damped or otherwise transmitted away from the windowpane in a safe manner. The assembly includes a series of segmented muntins that cooperate with and are interconnected at right angles to continuous exterior muntin bars with interior caps. A separate carbon fiber insert is provided adjacent the stile and rail members of the sash.

DETAILED DESCRIPTION OF THE INVENTION

The present invention relates to a window glazing assembly of the type as generally shown and described in U.S. Pat. No. 6,301,852, the relevant portions of which are incorporated herein by reference.

Figure 1:
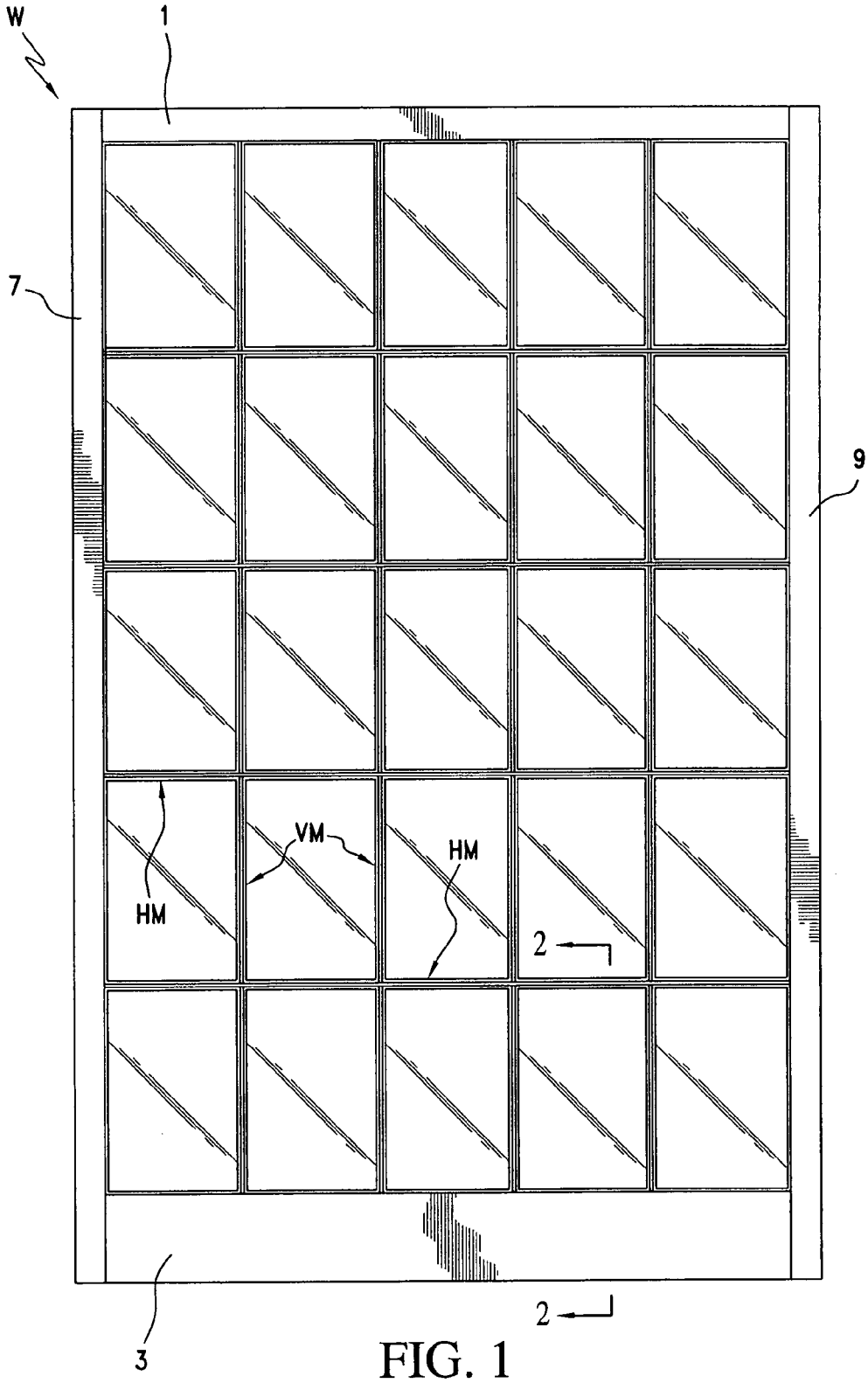
FIG. 1 is an elevation of the exterior of a window provided with the glazing system of the present invention.

FIG. 1 illustrates a window W fitted with a divided light glazing assembly according to the present invention. The present invention is applicable to a variety of window and door constructions as would be apparent to one of skill in the art.

Window W includes a peripheral frame member comprising a top rail 1, bottom rail 3 and stiles 7 and 9 interconnected in the known manner. Also shown are intersecting vertical muntins VM and horizontal muntins HM extending across the window frame.

Figure 2:
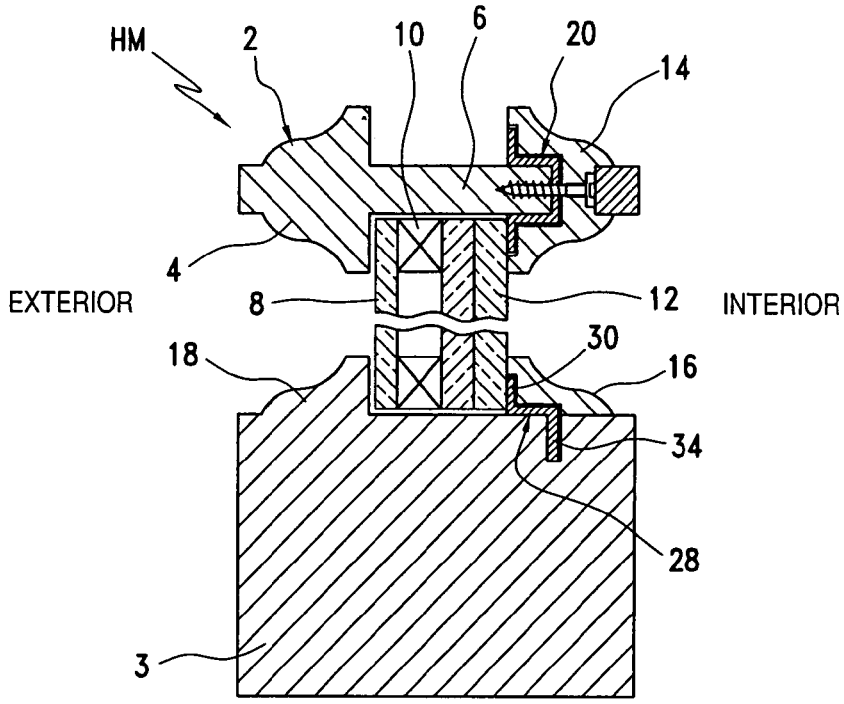
FIG. 2 is an enlarged sectional view taken along lines 2-2 of FIG. 1.

FIG. 2 illustrates assembly details regarding a horizontal muntin HM which includes an exterior muntin member 2 having a shaped face 4 and an integral bar portion 6. A cooperating interior muntin member 14 having a shaped face receives post member 6 within a slot cut into the interior muntin member 14 to provide a channel for receiving and retaining exterior glass pane 8, interior glass panes 12 and seal member 10. Bottom rail 3 of window W is provided with an exterior muntin face 18 formed or otherwise cut into the rail and a separate interior glazing stop 16.

A carbon fiber insert 20 is provided between the end of bar portion 6 and the slot formed within the interior muntin member 14. A screw assembly is provided to secure the interior muntin member 14 and the carbon fiber insert 20 against glass pane 12 as best shown in FIG. 2. A removable muntin cap is provided over the screw head. As is apparent, other methods of securing the carbon fiber insert within the muntin assembly to hold the glass panes in place are within the scope of the present invention.

Figure 4A:
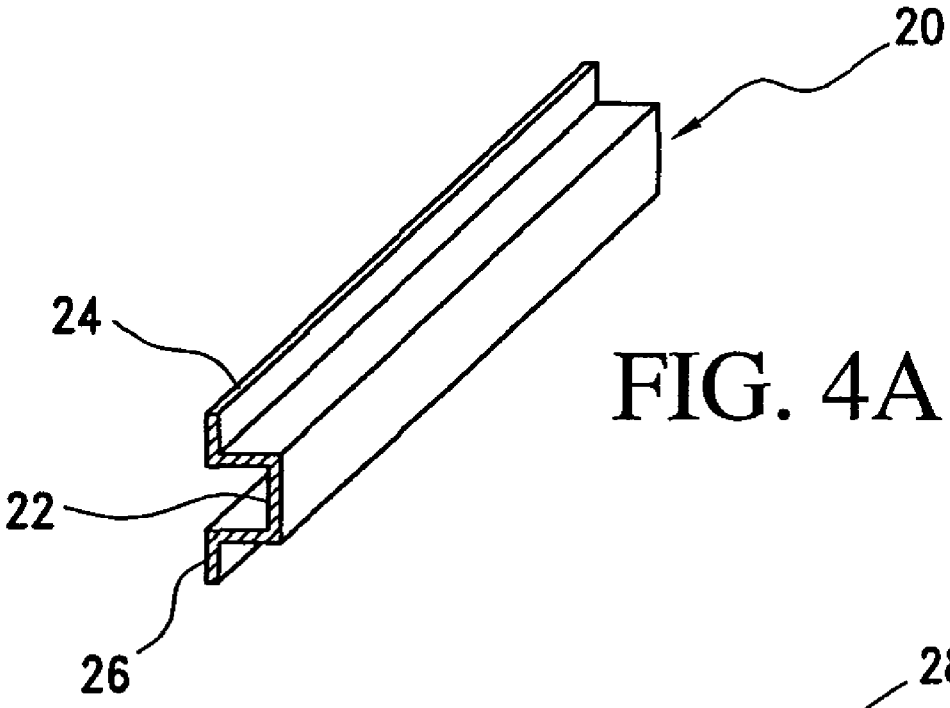
FIG. 4A is a perspective view of the carbon fiber reinforcing channel of the present invention.

As best shown in FIG. 4A, the carbon fiber insert 20 has a generally hat-shaped configuration in cross section and a central channel portion 22 for reinforcing the interconnection between interior muntin member 14 and bar portion 6. Carbon fiber insert 20 is provided with a pair of flange members 24 and 26 that extend from each side of the central channel portion 22 and which, when assembled within the horizontal muntin HM, rest directly against a pane of glass 12 to support the glass and to distribute load throughout the perimeter edge of the glass and into the glazing stop or muntin in the event the glass is subjected to high winds or impact.

In the case of the horizontal muntin HM shown in FIG. 2, the carbon fiber insert has a length extending continuously from stile 7 to stile 9. In an embodiment where the carbon fiber insert is provided within a vertical muntin VM, the carbon fiber insert 20 will have a length extending from the top rail 1 to bottom rail 3.

Figure 4B:
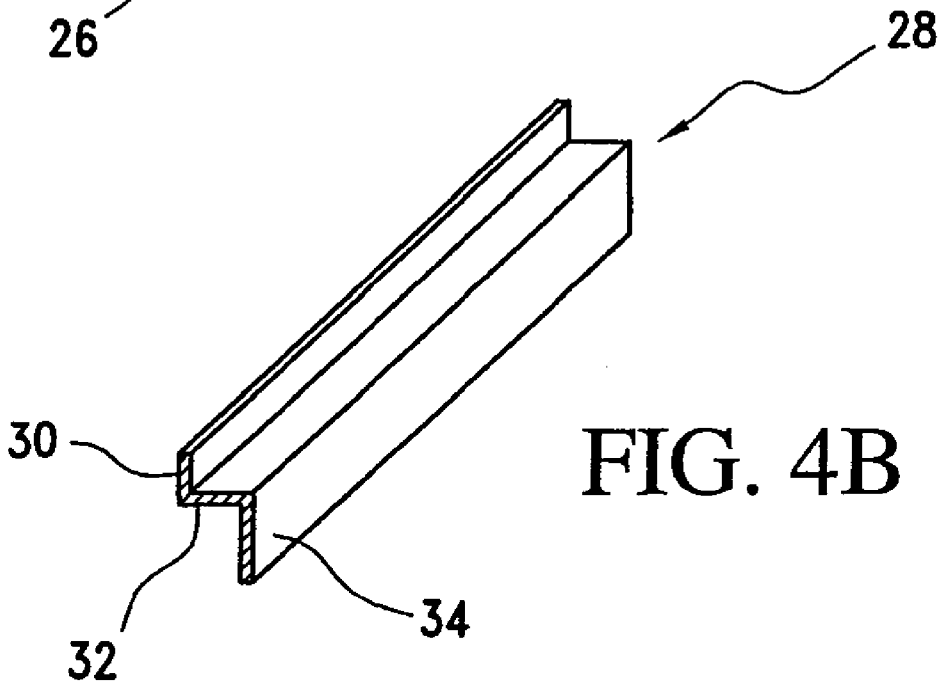
FIG. 4B is a perspective view showing another embodiment of the carbon fiber reinforcing channel according to the present invention.

As best shown in FIG. 2, a second carbon fiber insert 28 is interfitted between a glazing stop 16 and a perimeter edge of a glass pane 12 when the horizontal muntin HM is adjacent rail 3. As is apparent, a second carbon fiber insert 28 is likewise adapted for interconnection with a stile (not shown) in the event carbon fiber insert 20 is provided within a vertical muntin adjacent the stile. The second carbon fiber insert 28 is shown in FIG. 4B to have a generally angular S-shaped configuration and will have a length extending the full width of the window frame between stile 7 and stile 9.

Turning to FIG. 2, second carbon fiber insert 28 can be seen to comprise a first flange 30 that engages a perimeter edge of glass pane 12 to secure the glass pane and to distribute any load on the glass pane in the same manner as is accomplished with respect to carbon fiber insert 20.

Second carbon fiber insert 28 further includes a central portion 32 and a downwardly extending flange 34 that is fitted within a slot cut within rail 3. An interior glazing stop 16 is fitted over the second carbon fiber channel 28 and secured using an adhesive or some means such as a screw or other connector.

As is apparent, a carbon fiber channel will typically be provided within each horizontal muntin HM of the window frame shown in FIG. 1 so that at least two opposing glass edges of each glass pane is provided with the load support afforded by the present invention. It is of course within the scope of the present invention to provide the carbon fiber insert within each of the vertical muntins VM and the stiles rather than the horizontal muntins HM and the rails 1 and 3.

The location of the carbon fiber insert within the muntins of a window will sometimes depend upon the dimensions of the window in order that the most effective reinforcement and load distribution is achieved. For example, a window having a substantially greater width than height might dispose the carbon fiber inserts of the present invention within the vertical muntins in an effort to most effectively distribute load and impact forces that may occur against that glass pane.

Figure 3:
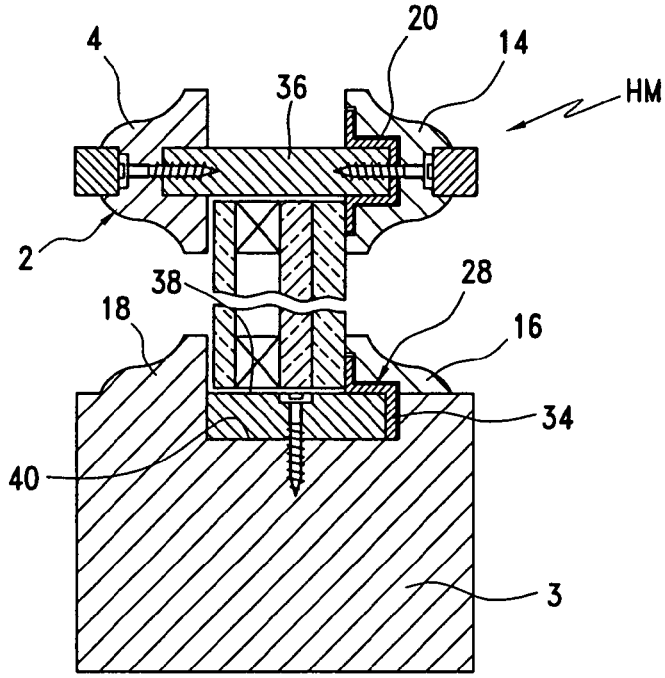
FIG. 3 is an alternative embodiment of the invention illustrated in FIG. 2.

Turning FIG. 3, a second embodiment of the present invention is shown. In this embodiment flitch plates or reinforcing bars 36 and 38 are provided. The flitch plate may be constructed from any rigid material including but not limited to stainless steel.

The horizontal muntin HM shown in FIG. 3 is similar to that shown in FIG. 2 but employs a flitch plate 36 rather than a bar portion 6. In this embodiment, the exterior muntin member 2 having a shaped face 4 is identical to the interior muntin member 14 and each includes a slot which receives an opposite side of the flitch plate 38 to provide a channel for receiving the glass panes in the manner shown.

A carbon fiber insert 20 is disposed between one side of the flitch plate 38 and the slot formed within the interior muntin member 14. As is apparent, the exterior muntin 2 may also be provided with an insert 20 or it alone may receive the insert depending upon the nature of the application and the desired load and impact resistance.

A screw assembly is provided to connect the interior muntin member 14 to the flitch plate and to secure the carbon fiber insert 20 against a glass pane 12 in the manner shown in FIG. 3. A removable muntin cap is provided over the screw head. As is apparent, other methods of securing the carbon fiber insert within the muntin assembly to hold the glass panes in place are within the scope of the present invention. A screw assembly is also provided to connect the exterior muntin member 2 to the flitch plate 36 so that the glass panes are secured in the manner as shown in FIG. 3.

The carbon fiber insert 20 has a generally hat-shaped configuration in cross section and a central channel portion 22 for reinforcing the interconnection between interior muntin member 14 and the flitch plate 36. A pair of flange members 24 and 26 extend from each side of the central channel portion 22 and rest against the glass panes so that load and impact forces against the glass are uniformly and effectively distributed without damage to the glass.

A second flitch plate 38 is provided within a recess 40 cut within the bottom rail 3 and the second flitch plate is secured by a countersunk screw as shown. A second carbon fiber insert 28 is provided and comprises a first flange 30 that engages a perimeter edge of glass pane 12 to secure the glass pane and to distribute any load on the glass pane in the same manner as earlier described with respect to FIG. 2. The second carbon fiber insert 28 includes a central portion 32 (FIG. 4B) and a downwardly extending flange 34 fitted within a slot that is cut within rail 3. The central portion 32 and the flange 34 contact one side of the flitch plate 38. An interior glazing stop is fitted over the second carbon fiber insert 28 and is secured with an adhesive or some means such as a screw or other connector.

Figure 5:
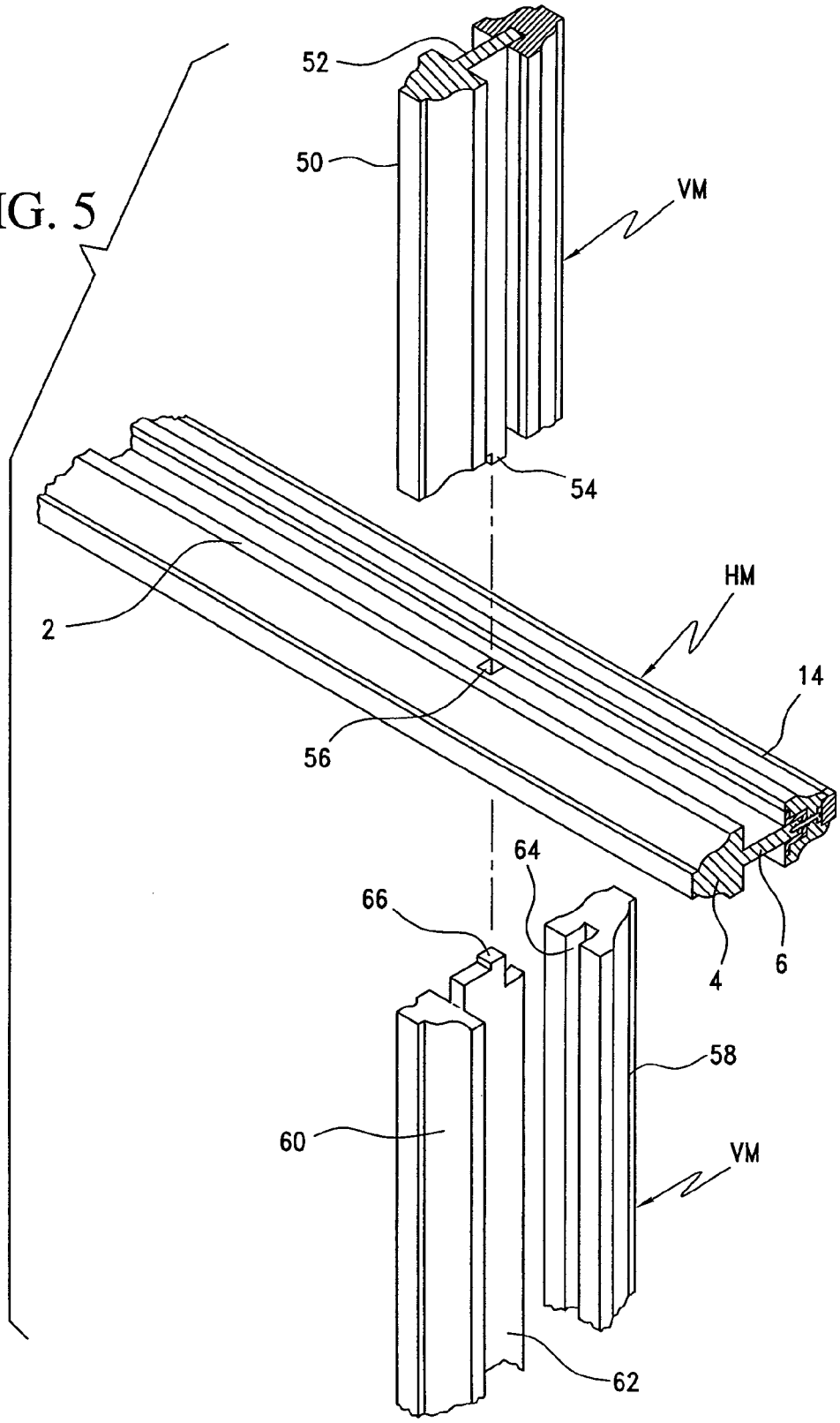
FIG. 5 is an exploded view showing the interconnection between the vertical and horizontal muntin bars of the present invention.

FIG. 5 illustrates the manner in which the segmented vertical muntins VM interconnect with the continuous horizontal muntin HM shown in FIG. 2. The segmented vertical muntins VM extend along the vertical axis of the window frame and intersect the bar portion 6 and the muntin faces 2 and 14 of the horizontal muntin HM at right angles so as to provide a glazing for glass panels (not shown). As is apparent, the segmented muntins may be arranged within a window frame in a variety of configurations and locations depending upon the design of the window.

Each segmented vertical muntin VM comprises an interior muntin portion 48 and exterior muntin member 50 having a bar portion 52 adapted to interfit a slot extending within muntin portion 48. The end of the segmented vertical muntin VM is provided with a tenon 54 configured to interfit a passageway 56 extending within bar portion 6 of horizontal muntin HM. As is apparent, each end of muntin portion 48 and muntin member 50 is shaped so as to uniformly insect the exterior faces of shaped muntin face 4 and interior muntin member 14 as is known in the art.

In a similar manner, the segmented vertical muntin VM shown situated below the horizontal muntin HM comprises an interior muntin portion 58 and exterior muntin member 60 having a bar portion 62 adapted to interfit a slot 64 extending within muntin portion 58. The end of the lower segmented vertical muntin VM is also provided with a tenon 66 configured to interfit passageway 56 that extends within bar portion 6 of the horizontal muntin HM. Each end of muntin portion 58 and muntin member 60 is shaped to provide a clean interfit against the exterior faces of the shaped muntin face 4 and interior muntin member 14.

Other approaches for attaching the segmented muntin the horizontal muntin are within the scope of the present invention so long as the locking system may be readily disassembled. For example, a pin or dowel may be employed.

As is apparent, the ends of the segmented vertical muntins VM adjacent the top rail 3 and bottom rail 7 may be secured to the top or bottom rail in any manner, including, but not limited to, a mortise and tenon interlock, pins, dowels or a bar plate countersunk within the rail or stile to which the end of the muntin VM is secured.

The glazing assembly of the present invention meets history landmark provisions and other design parameters that require manufacturers to maintain specific material use and fabrication methods while at the same time providing increased structural and impact resistance performance beyond that available from traditional wooden sash and door components and fabrication methods.

The present invention enhances the structural support of a conventional wooden sash and door divided light muntin assembly so that the panes of glass held by the muntin meet wind load and impact resistance standards yet also enable easy extraction of the glazing stops when replacement of the glass is desired.

The present invention solves a problem inherent in traditional mortise and tenon wood joinery; namely, the inability of such structures to withstand a high degree of wind load and impact resistance regardless of the type of wood used in the construction. The carbon fiber inserts 20 and 28 of the present invention effectively transmit any load and impact forces occurring against the glass away from the glass so as to prevent damage to the glass. The use of a bar portion or flitch plate inserted within a cooperating muntin in combination with a carbon fiber insert at that interconnection provides superior resistance to load and impact forces occurring against the glass. The present invention allows individual panes of insulating glass to be subjected to maintenance or replaced without having to also replace the entire wooden sash or door leaf.

While this invention has been described as having a preferred design, it is understood that it is capable of further modifications, and uses and/or adaptations following in general the principle of the invention and including such departures from the present disclosure as come within the known or customary practice in the art to which the invention pertains, and as may be applied to the central features hereinbefore set forth and within the scope of the invention.

What is claimed is:

1. A muntin framework for supporting and separating individual panes of glass within the sash of a window or door, said muntin framework comprising:

a) at least one exterior muntin bar, said at least one exterior muntin bar having a length extending continuously from one end of said sash to an opposite end thereof;

b) at least one interior muntin cap configured for connection with said at least one exterior muntin bar for supporting and separating a plurality of windowpanes, said at least one interior muntin cap is configured to receive interior thereof at least a portion of said at least one exterior muntin bar so as to provide a connection therewith;

c) at least one insert member formed from carbon fiber, said at least one carbon fiber insert member comprising a channel portion and at least one flange member, said channel portion is disposed between said at least one exterior muntin bar and said interior muntin cap and at said connection thereto, said at least one flange member is configured for engaging a peripheral edge of the windowpane to be supported so that wind load or impact against the windowpane is caused to be damped.

2. A muntin framework as in claim 1 and further comprising:

a) additional exterior muntin bars and cooperating interior muntin caps whereby said muntin framework is an intersecting lattice for supporting a plurality of individual glass panes.

3. A muntin framework as in claim 1 wherein said at least one exterior muntin bar and said interior muntin cap are constructed from wood material.

4. A muntin framework as in claim 2 and further comprising:

a) additional insert members formed from carbon fiber, said at least one carbon fiber insert member and said additional carbon fiber insert members extend the width of said lattice.

5. A muntin framework as in claim 1 and wherein said at least one carbon fiber insert member having a second flange, said first and second flanges extending from said channel portion at right angles thereto.

6. A muntin framework as in claim 1 and wherein said at least one carbon fiber insert member is U-shaped in cross section.

7. A muntin framework as in claim 1 and further including:

a) at least one perimeter edge insert member formed from carbon fiber, said at least one perimeter edge carbon fiber insert member comprising a central portion and two flange members, said two flange members extend in opposite direction from each other and at right angles to said central portion.

8. A muntin framework as in claim 1 and wherein said at least one carbon fiber insert member is fixedly attached to said at least one exterior muntin bar and said at least interior muntin cap.

9. A muntin framework as in claim 8 and wherein said at least one carbon fiber insert member is fixedly attached with a fastener.

10. A muntin framework as in claim 1 and wherein said at least one exterior muntin bar is unitary in construction.

11. A muntin framework as in claim 1 and wherein said at least one exterior muntin bar comprising a muntin cap and cooperating muntin flitch plate member, said at least one interior muntin cap is configured for connection with said muntin flitch plate member.

12. A muntin framework as in claim 11 and further comprising:

a) a second flitch plate; and b) a glazing stop, said second flitch plate configured to be received within the sash of a window or door, said second flitch plate cooperating with said at least one perimeter edge insert member formed from carbon fiber and said glazing stop to support a glass pane.

13. A muntin framework as in claim 1 wherein said at least one interior muntin cap having a channel extending therein to receive said at least one carbon fiber insert member.

14. A muntin framework as in claim 13 and wherein said at least one interior muntin cap channel is configured to receive said channel portion and said at least one flange member of said at least one carbon fiber insert member.

* * * * *